United States Patent [19]

Lawler

[11] 4,018,354

[45] Apr. 19, 1977

[54] TANK SHELL WITH INTEGRAL WALKWAY

[76] Inventor: James H. Lawler, 5879 Paint Valley Drive, Rochester, Mich. 48063

[22] Filed: Oct. 31, 1975

[21] Appl. No.: 627,524

[52] U.S. Cl. ..... 220/20; 220/1 V

[51] Int. Cl.[2] ..... B65D 7/02; B65D 7/34

[58] Field of Search ..... 220/20, 20.5, 22, 1 B, 220/DIG. 24, 20, 1 V; 280/5 C, 5 D, 5 E

[56] References Cited

UNITED STATES PATENTS

| | | | |
|---|---|---|---|
| 1,462,347 | 7/1923 | Kramer | 220/20 X |
| 2,056,820 | 10/1936 | Bradley et al. | 220/1 V |
| 2,160,477 | 5/1939 | Kramer | 220/DIG. 24 |
| 2,229,793 | 1/1941 | Bradley | 220/1 V |

*Primary Examiner*—William Price
*Assistant Examiner*—Steven M. Pollard
*Attorney, Agent, or Firm*—Hauke & Patalidis

[57] ABSTRACT

A tank shell for the transport of bulk material such as liquid petroleum, gasoline or fuel oil and the like, chemicals, milk, and the like, mounted on the bed or frame of a vehicle such as a railroad car, a highway truck, a semi-trailer or a trailer, or the like, and provided with laterally disposed walkways running the whole length of the tank shell. Each walkway is formed integrally in a lateral wall of the shell having a stepped portion disposed substantially horizontally and forming the floor of the walkway, portions of the shell extending below the walkways and the floor of the walkways forming the top of such portion of the shell.

13 Claims, 5 Drawing Figures

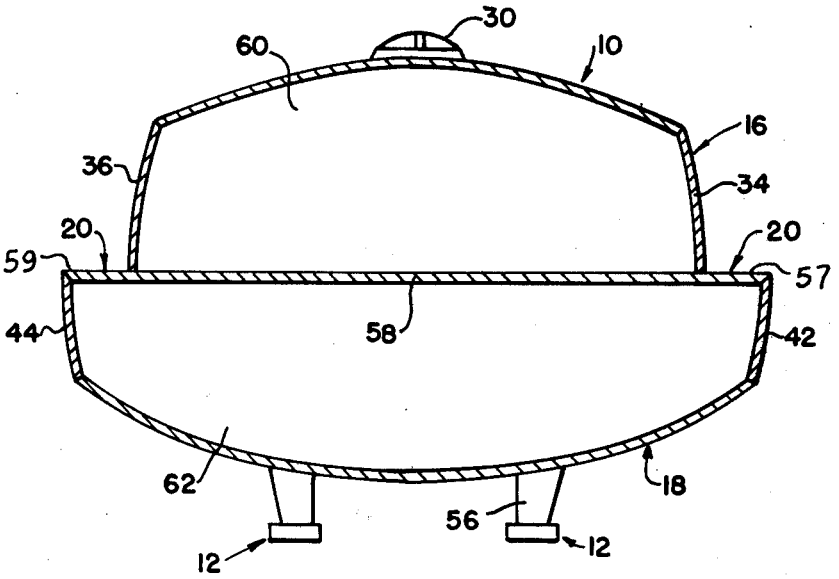
FIG.3
FIG.4
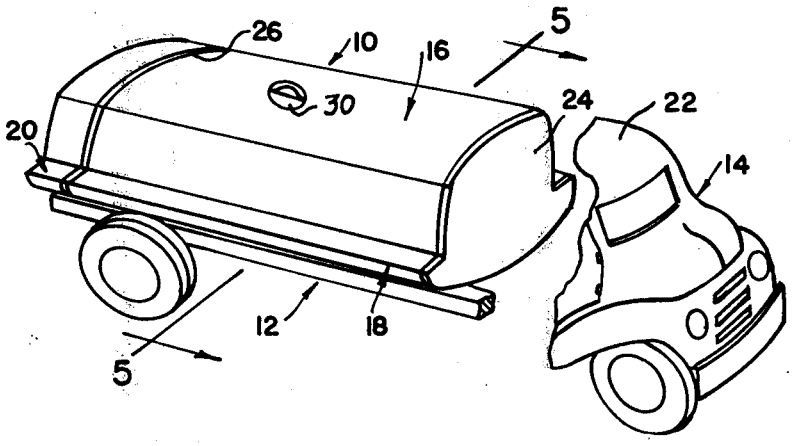
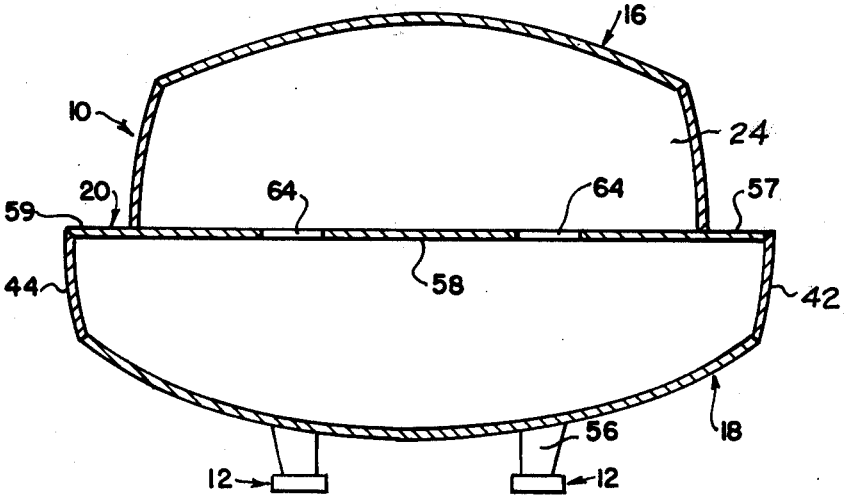
FIG.5

TANK SHELL WITH INTEGRAL WALKWAY

BACKGROUND OF THE PRESENT INVENTION

The invention relates to a tank shell for the transport of bulk material and, more particularly, to a tank shell for the transport of bulk liquid material.

Although the present invention may be used in connection with the railroad transport industry, it has particular applications in the trucking industry for the transport of bulk material such as fuel oil, gasoline and the like, and the tank shell of the present invention is particularly adapted to be mounted on the bed or frame of a truck, a trailer or a semi-trailer.

Transport tanks, especially for mounting on a truck frame, a trailer frame or a semi-trailer frame, are generally provided with filling means disposed on the top of the tank body and with a catwalk supported by the roof or top of the tank body for permitting a person to gain access to the filling means for filling the interior of the tank body with an appropriate bulk material. Steps, or a ladder, are disposed at one end of the body shell such as to permit a person to climb to the catwalk. At one end of the tank body, appropriate service equipment such as pumps, flow-meters and hoses wound on reels are disposed in a separate compartment accessible from the exterior by way of appropriate doors. The interior of the tank body may be compartmented, with separate filling means and separate distribution means such that two or more grades of fuel, for example, may be transported in a single tank body.

The present invention permits to do away with the conventional catwalk and steps or ladder by providing a longitudinally extending walkway, preferably on each side of the tank shell, such walkway being formed integrally in each lateral wall of the shell and forming an integral portion of the sheel structure. The walkways are formed at a convenient height, such as a height corresponding generally to the height of the dock of a bulk storage filling station, thus permitting a person to easily step over from the dock to the walkway when the tank vehicle is parked along the dock, for the purpose of opening and closing the filler domes and manipulating the nozzle of the filling overhead pipelines.

SUMMARY OF THE PRESENT INVENTION

The present invention accomplishes its object by providing a unitary structure for a tank shell made of a plurality of simple panels, preferably bent slightly outwardly, interconnected by means of straightline welded joints, and by providing integral walkways disposed on both sides of the shell forming a lateral integral portion of the shell structure. Furthermore, the present invention permits to obtain a substantially rigid, undeformable structure, having a large capacity and which can be conveniently compartmented vertically or horizontally and which is of greatly increased capacity as compared to more conventional structures.

BRIEF DESCRIPTION OF THE DRAWINGS

FIG. 3 is a partial view similar to FIG. 2 but showing a modification of the invention;

FIG. 4 is a perspective view of a modification of the invention; and

FIG. 5 is a section along line 5—5 of FIG. 4.

DETAILED DESCRIPTION OF THE PREFERRED EMBODIMENT

Figure 1:
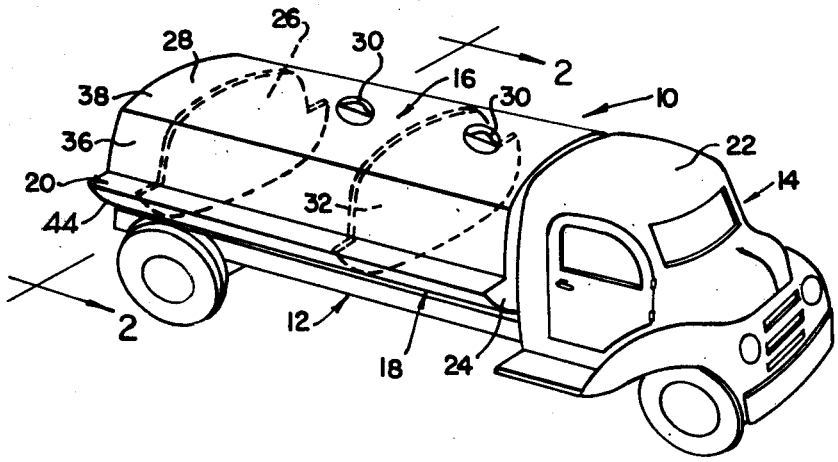
FIG. 1 is a simplified perspective view of a tank truck provided with a tank shell according to the present invention.
Figure 2:
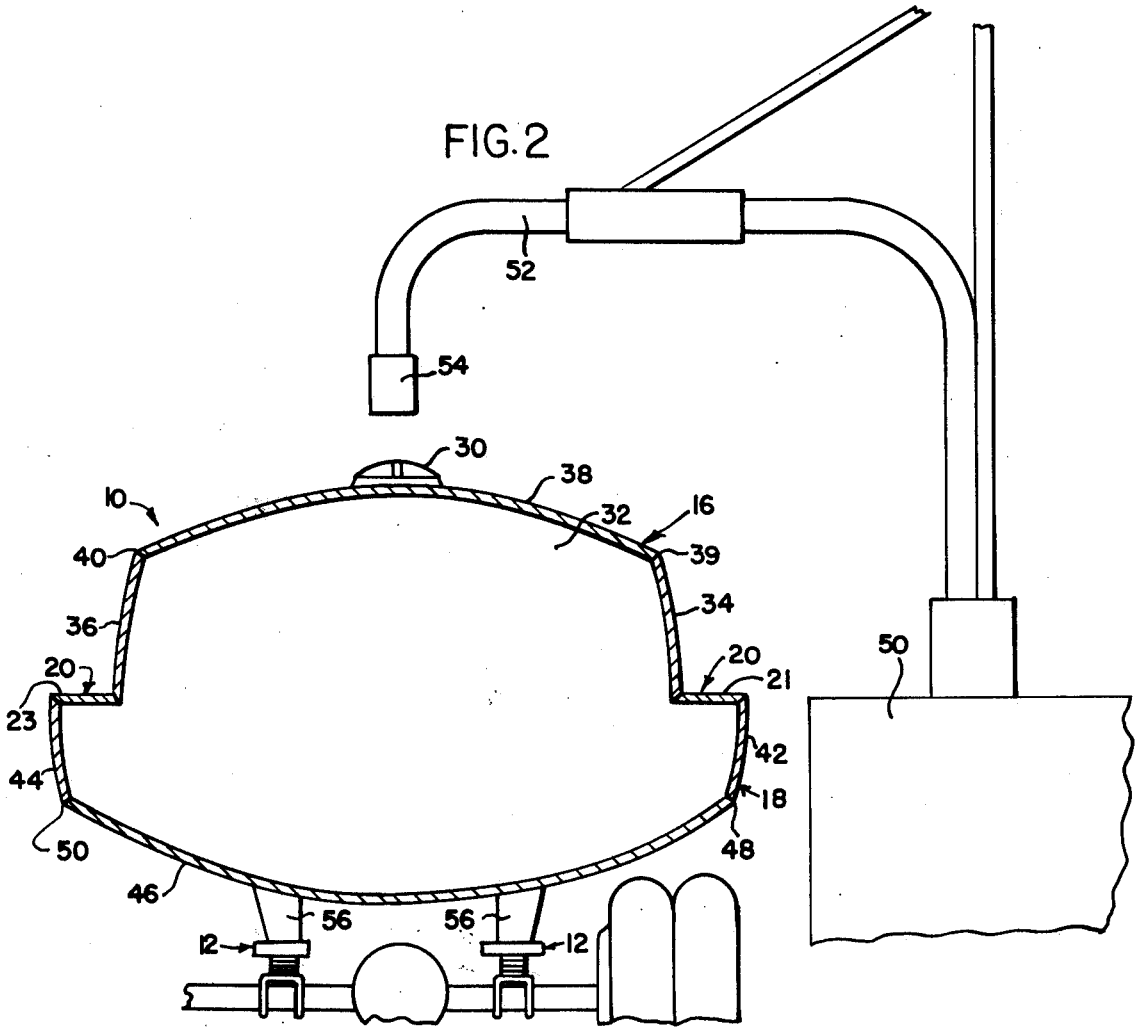
FIG. 2 is a section along line 2—2 of FIG. 1.

For illustrative purposes a tank shell 10, according to the present invention, for the transport of bulk material such as liquid petroleums, milk, water, or the like, has been illustrated at FIGS. 1 and 2 mounted on the bed or frame 12 of a truck 14. The shell 10 is generally in the form of a pair of cylindrical half-shells defining an upper half-shell 16 and a lower half-shell 18 of different diameters about a horizontal plane, the lower half-shell 18 having the larger diameter. At the junction of the two half-shells, a substantially horizontally disposed walkway 20 is formed on each lateral wall of the shell 10. Each end of the shell 10 is closed by way of a substantially vertical wall or bulkhead member. A bulkhead member is disposed at the front of the shell, i.e. proximate the cab 22, such forward bulkhead member being designated by numeral 24 at FIG. 1. A rear bulkhead member 26 defines the rear wall of the tank shell 10. A separate service compartment 28 is provided, preferably at the rear of the tank shell 10, for sheltering the pumps, flow-meters, hoses and hose reels whose function it is to empty the tank and measure the quantity of bulk material supplied to a customer. The service compartment 28 opens to the rear of the vehicle by means of appropriate doors.

The tank shell 10 may be filled with bulk material by way of appropriate filling means such as the lidded domes 30, in a conventional manner, a pair of such lidded domes 30 being shown at FIG. 1. In the representation of FIG. 1, an intermediate bulkhead member 32 is placed on the interior of the tank shell 10 so as to separate the tank shell into two compartments, each provided with appropriate filling means, such as one of the lidded domes 30, and with appropriate outlet pumps, flow-meters and hoses, not shown. In this manner, two different liquids may be transported in the same tank shell such as, for example, two different grades of fuel.

In the structure illustrated at FIGS. 1–2, the upper half-shell 16 can be molded or cast in a single piece, but is preferably made of a pair of lateral metallic panels 34 and 36, slightly arcuate or curvilinear in section, with their convexity directed towards the outside, and of a roof panel 38, also slightly arcuate or curvilinear in section, with its convexity outwardly directed. The roof panel 38 is welded at its edges to the upper edge of the lateral panels 34 and 36, as shown at 39 and 40. The lower half-shell 18 is formed, in the same manner, by welding two lateral panels 42 and 44, slightly arcuate or curvilinear outwardly, to a lower panel 36, also arcuate or curvilinear in cross section, with its convexity outwardly directed, the welding line being at the adjoining edges of the panels as shown at 48 and 50. Alternatively, the lower half-shell 18 may be molded or cast of a single piece.

In this manner, the upper half-shell 16 and the lower half-shell 18 form partially tubular members, the lower half-shell 18 being of a larger diameter than the upper half-shell 16, and the two half-shells are joined about a horizontal plane by way of relatively narrow panels 21 and 23 forming the floor of the lateral walkways 20, such panels 21 and 23 being welded to the lower edge of the upper lateral panels 34–36 and to the upper edge of the lower lateral panels 42–44. In the structure illustrated at FIGS. 1–2, the end bulkhead members 24 and 26 and the intermediate bulkhead member 32, if such intermediate bulkhead is used, are preferably welded to the interior surface of the shell 10.

The height of the floor of lateral walkways 20 above the ground is preferably about the same as the height of a conventional dock platform 50 (FIG. 2), such that a person may readily walk from the platform 50 to a walkway 20 for reaching the lid of a filler dome 30 and for manipulating an overhead pipeline 52 having an appropriate nozzle 54 for filling the tank shell 10 with a bulk liquid material. One or two steps, not shown, may be provided at the rear or on the side of the tank shell 10 for gaining access to the walkways 20. As shown at FIG. 2, the tank shell 10 is supported from the frame 12 of the truck by way of appropriate support legs 56 bolted or welded to the support and supported elements.

The bulkhead member 32 may be imperforate, in which case it acts as a partition compartmentalizing the tank shell 10 into two separate containers such that different bulk materials may be transported on the same vehicle without intermixing. Alternatively, the intermediate bulkhead member 32 may be perforate such that the two sections of the tank shell 10 separated by the intermediate bulkhead member are in communication, in which case the intermediate bulkhead member 32 acts as a reinforcing and support member and as a baffle preventing excessive slushing of the bulk material when the tank is only half or partially full.

As schematically illustrated at FIG. 3, the invention contemplates that the tank shell 10 may be horizontally compartmented by way of a horizontally disposed panel 58 welded at its lateral edges to the upper edge of the side panels 42 and 44, such as to provide a top closure for the lower half-shell 18, the upper half-shell 16 being disposed with the lower edge of the side panels 34 and 36 welded to the top surface of the panel 58, such as to provide a walkway 20 on each side thereof. The floor of each walkway consists of the upper surface portion 57 and 59 of the horizontal panel 58 projecting from under the upper half-shell 16.

By leaving the panel 58 imperforate, a pair of separate containers 60 and 62 are thus formed, one above the other, and each serviced by an appropriate filling dome 30 and capable of being emptied by separate outlet means. If so desired, the panel 58 may be perforate, as shown at 64 at FIG. 5, so as to place the two separate containers 60 and 62 into communication with each other.

An alternate construction is shown at FIG. 4 wherein the end bulkhead members 24 and 26 are made with their periphery corresponding to the outer periphery of the tank shell 10, the upper, lower and side panels abutting against a side face of the bulkhead members and being welded thereto. In the structure illustrated at FIG. 4, the lateral walkways 20 may be made of separate panels or they may be the outer portions of a horizontally disposed panel, such as panel 58 of FIGS. 3 and 5.

Having thus described the invention by way of typical structural examples thereof, modifications whereof will be apparent to those skilled in the art, what is claimed as new is as follows:

1. In a tank shell for the transport of bulk material the improvement comprising at least one walkway extending longitudinally from end to end of said shell, said walkway being formed integrally in a lateral wall of said shell having a stepped portion disposed substantially horizontally defining the floor of said walkway and the top of a portion of said shell extending below said walkway.

2. The improvement of claim 1 comprising a pair of said walkways disposed each in each lateral wall of said shell.

3. In a tank shell for the transport of bulk material, said shell comprising a top, a bottom, lateral walls and end walls, the improvement comprising at least one lateral walkway extending longitudinally from end to end of said shell, said walkway being formed integrally in one of said lateral walls intermediary the top and bottom of said shell and a portion of said lateral wall forming the floor of said walkway and the top of a portion of said shell laterally extending below said walkway.

4. The improvement of claim 3 comprising a pair of said walkways disposed each in a different lateral wall of said shell.

5. The improvement of claim 4 wherein said shell is in the form of a pair of tubular members of different diameters, said tubular members being joined together about a longitudinal substantially horizontal plane intersecting said tubular members substantially about a diameter, the tubular member of larger diameter being disposed below the tubular member of smaller diameter and said walkways being disposed at the junction of said tubular members along said substantially horizontal plane.

6. The improvement of claim 5 wherein each of said tubular members comprises a pair of lateral panels and a central panel interconnecting said lateral panels at corresponding edges of said lateral panels, said panels being curvilinear in section with a convexity directed outwardly.

7. The improvement of claim 5 further comprising a bulkhead member closing said shell at each end thereof and forming said end walls.

8. The improvement of claim 7 further comprising at least one substantially vertical bulkhead member disposed intermediate said end bulkheads.

9. The improvement of claim 5 further comprising a partition along said horizontal plane, a portion of said partition laterally projecting one each side of said shell and forming the floor of said walkways.

10. The improvement of claim 9 wherein said partition is imperforate and separates said shell into a pair of compartments one above the other.

11. The improvement of claim 9 wherein said partition is perforate.

12. The improvement of claim 8 wherein said intermediate bulkhead member is imperforate and separates said shell into a pair of compartments.

13. The improvement of claim 8 wherein said intermediate bulkhead member is perforate.

* * * * *